US005279138A

United States Patent [19]

Gallagher

[11] Patent Number: 5,279,138

[45] Date of Patent: Jan. 18, 1994

[54] LOCK HAVING REMOVABLE LOCK-ACTUATOR CARTRIDGE

[76] Inventor: Francis E. Gallagher, 3800 N. Bradford, LaVerne, Calif. 91750

[21] Appl. No.: 878,340

[22] Filed: May 4, 1992

[51] Int. Cl.[5] ..... E05B 29/00

[52] U.S. Cl. ..... 70/366; 70/371; 70/407; 70/369; 70/377

[58] Field of Search ..... 70/366, 417, 365, 371, 70/370, 406, 407, 377, 368, 369

[56] References Cited

U.S. PATENT DOCUMENTS

| | | | |
|---|---|---|---|
| 1,644,365 | 10/1927 | Bennett | 70/377 |
| 2,012,996 | 9/1935 | Jacobi | 70/370 |
| 3,600,912 | 8/1971 | Foreman | 70/77 |
| 3,789,638 | 2/1974 | Roberts et al. | 70/417 |
| 3,797,290 | 3/1974 | Taylor | 70/377 |
| 3,821,886 | 7/1974 | Ladewig | 70/366 |
| 3,942,346 | 3/1976 | Luotolainen | 70/377 |
| 4,123,926 | 11/1978 | Elder | 70/369 |
| 4,838,055 | 6/1989 | Gallagher | 70/366 |

FOREIGN PATENT DOCUMENTS

| | | | |
|---|---|---|---|
| 2245729 | 4/1974 | Fed. Rep. of Germany | 70/366 |
| 2913248 | 10/1979 | Fed. Rep. of Germany | 70/366 |
| 2161536 | 1/1986 | United Kingdom | 70/366 |

*Primary Examiner*—Peter M. Cuomo
*Assistant Examiner*—Darnell M. Boucher
*Attorney, Agent, or Firm*—Boniard I. Brown

[57] ABSTRACT

A key-operated lock has a shell mounted securely in a closure, and a removable lock-actuator cartridge insertable into and withdrawal from the shell to facilitate changing the tumbler disk combination in the lock. The cartridge includes an annular hollow housing seatable in the shell, and a tumbler disk carrier telescopically insertable into the housing. The carrier and associated tumbler disks are rotatable within the housing to operate the lock. An anti-damage feature comprises the cartridge being insertable into the open front end of the shell. A thickened rear wall of the shell reinforces the cartridge against destructive attack by rod and hammer action exerted on the front face of the lock. Principal features are quick changing of the tumbler disk pattern, and a rigid damage-resistant lock structure.

8 Claims, 3 Drawing Sheets

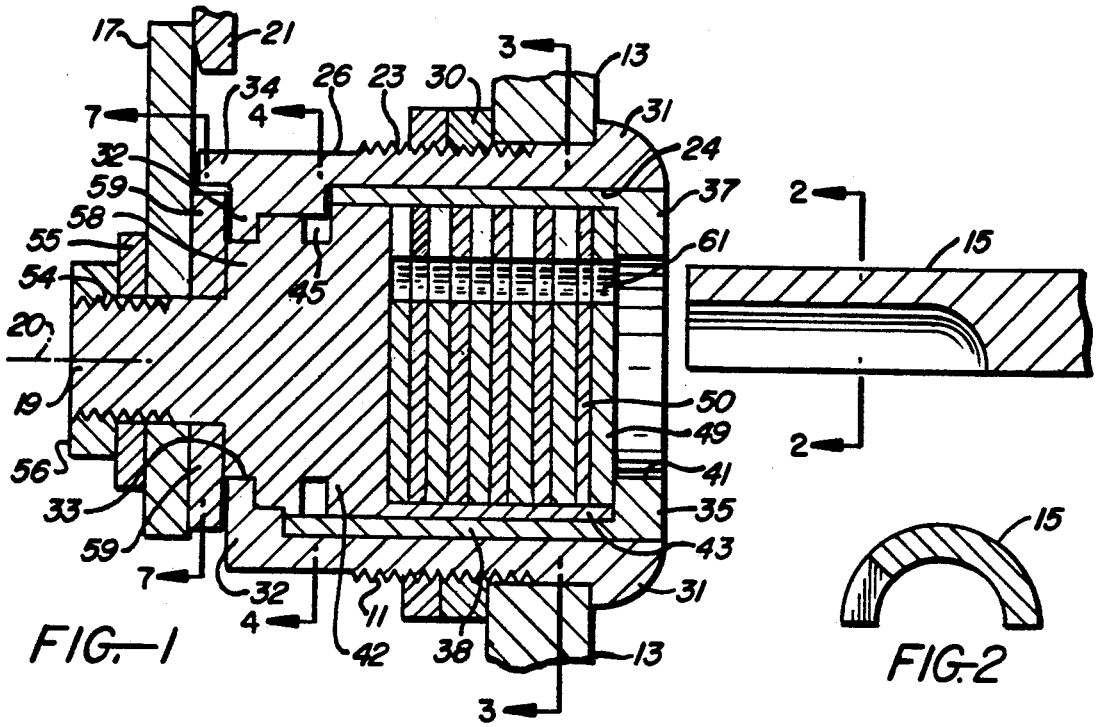
FIG.—1
FIG.-2
FIG.—4
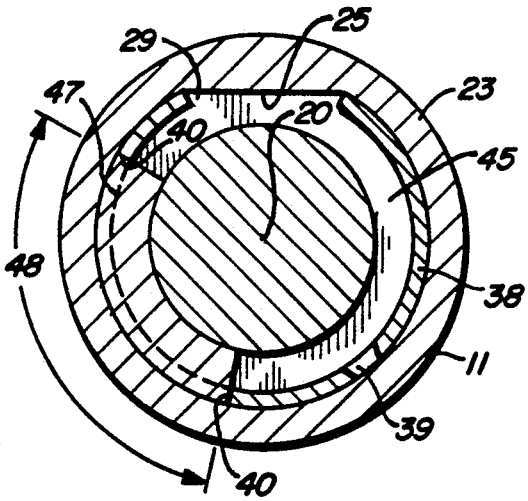
FIG.—3
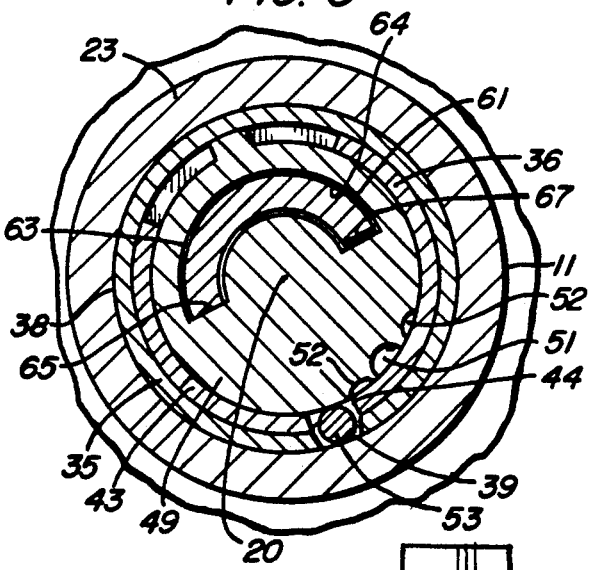
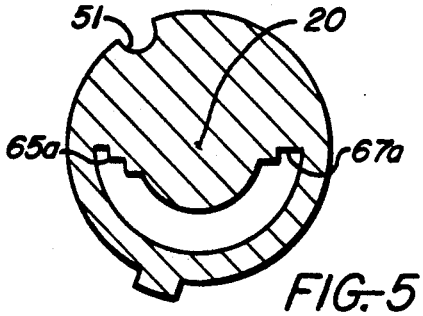
FIG.-5
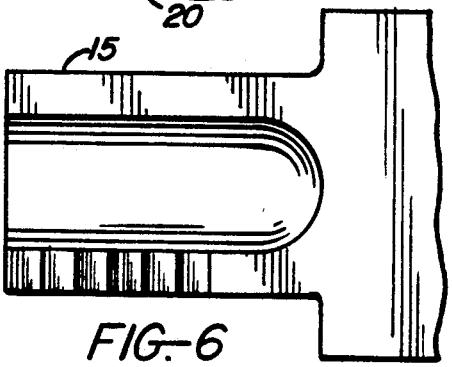
FIG.-6

LOCK HAVING REMOVABLE LOCK-ACTUATOR CARTRIDGE

BACKGROUND OF THE INVENTION

1. Field of the Invention

The present invention relates to rotary key-operated locks, e.g., locks installable on the closures of vending or gambling machines to limit access to the machine interior.

2. Prior Developments

It is known to equip vending machines with rotary tumbler disk locks. A tumbler disk lock often includes a housing adapted to be affixed to a vending machine closure, and a rotary tumbler carrier within the housing for supporting a stack of tumbler disks; the number of tumbler disks can vary from about five disks to about fourteen disks, depending upon the desired degree of protection provided by the lock. Each tumbler disk has a key slot and at least one notch (gate) in its peripheral edge, the gate locations being different in the different disks. A horizontal drive pin is supported within the lock housing above the stack of tumbler disks, whereby when a correctly configured key is inserted through the key slots and turned, the various disks are rotated to predetermined degrees for alignment of the gates below the drive pin, thereby allowing the drive pin to drop into the aligned gates. The drive pin then acts as a driving connection between the tumbler disks and the tumbler carrier, whereby the carrier is enabled to rotate within the housing to operate a locking element attached to the rear end of the carrier.

In many cases the carrier is open at its rear end for initially loading the tumbler disks into the carrier. The carrier is therefore subject to frontal attack by thieves or persons seeking access to the vending machine for the purpose of removing money or vended items from the machine. Commonly, such frontal attack involves placing a steel rod endwise against the frontmost tumbler disk, and forcibly striking the other end of the rod with a hammer. Often, the lock housing or tumbler carrier will be damaged by such hammer blows to such an extent as to destroy the locking action of the lock mechanism.

Another problem with conventional tumbler disk locks is that the lock housing usually must be completely removed from the vending machine closure to insert a stack of tumbler disks into the tumbler carrier. The tumbler disks have to be inserted into the carrier in a particular order, to mate with the appropriate key and drive pin in the lock housing. The tumbler disk insertion process is time-consuming and is subject to error, due partly to the fact that the technician usually is working in a store or commercial area where work benches and equipment are not available. The problem is magnified when may vending machine locks must be rekeyed at approximately the same time, e.g., when large numbers of keys have been stolen at one time or when large numbers of vending machines have been vandalized.

A further problem associated with tumbler disk locks is the unauthorized opening of the lock with a picking tool. The picking tool is inserted into the key hole and manipulated to turn the tumbler disks to positions wherein the gate notches are aligned with the drive pin. The picking tool is most successful when the keyhole slots are relatively large or wide so that the tool can be adequately supported on an edge of a keyhole slot while it is being manipulated to move each tumbler disk.

SUMMARY OF THE INVENTION

The present invention relates to a key-operated lock designed to overcome the aforementioned problems. In one embodiment of the invention, the tumbler disks are supported in a cartridge which is removable from an annular supporting shell in order to change the tumbler disk arrangement. During the process of rekeying the lock, the shell remains attached to the closure of the vending machine or other closure on which the lock is installed. The rekeying process involves replacing the existing cartridge with a different cartridge. The substeps of orienting the tumbler disks within the cartridge can be performed away from the job site, as in a locksmith shop.

It is contemplated that a supply of cartridges may be built up and maintained at a locksmith facility and ready for installation in different vending machines as the need may arise. The rekeying operation may involve removal of a given cartridge from the supporting shell, and the insertion of a different cartridge into the shell. Major advantages are a quicker process and a greater certainty that the tumbler disk assembly will have the necessary match with the selected key, because the key and tumbler disk assembly will already have been tested together at the locksmith facility.

In a preferred embodiment of the invention, the supporting shell for the tumbler cartridge has a thickened rear wall resistant to damage by frontal attack with a rod and hammer apparatus. The cartridge is inserted through an open front end of the shell so that a rear end surface of the cartridge abuts the thickened rear wall of the shell. Should a steel rod be forcibly hammered against the exposed face of the tumbler assembly, the shell rear wall acts as a reinforcement to prevent the cartridge from being driven rearwardly through the shell to destroy the locking action of the lock assembly.

The tumbler disks may preferably be operated with a specially designed key of arcuate cross-section. Each tumbler disk has an arcuate semi-circular key slot centered on the lock rotational axis, such that the key has a relatively thick arcuate cross-section resistant to wear or deformation. Each semi-circular key slot has an arcuate inner edge, an arcuate outer edge, and two connecting end edges. The end edges have steps formed therein for reducing the potential support surface available to a lock picking tool which might be inserted into the keyhole slot to turn the tumbler disks.

The stepped end edge configuration of the keyhole slot has the effect of reducing the transverse thickness of any picking tool which might be used to enter into the spaces between the tumbler disks. With a thinner cross-section, the tool does not have sufficient strength or rigidity to hook onto a given tumbler disk and turn it to the unlocking position. Also, the portion of the picking tool resting on the stepped edge of the keyhole is susceptible to slipping off the narrow edge, thereby defeating the picking operation. The stepped end edge configuration is also advantageous in that the mating key must have a corresponding special edge configuration. A key forger is less likely to go to the trouble of duplicating the special stepped edge configuration key. The combination of a smaller keyhole end edge area and uniquely profiled key will, in most instances, prevent or deter any attempt at picking the lock or duplicating the key.

BRIEF DESCRIPTION OF THE DRAWINGS

FIG. 1 is a sectional view through the key-operated lock assembly according to the present invention;

FIG. 2 is a sectional view taken on line 2—2 in FIG. 1;

FIG. 3 is a sectional view taken on line 3—3 in FIG. 1;

FIG. 4 is a sectional view taken on line 4—4 in FIG. 1;

FIG. 5 is a sectional view of a tumbler disk utilized in another embodiment of the invention;

FIG. 6 is a plan view of the key shown in FIG. 2;

DESCRIPTION OF A PREFERRED EMBODIMENT OF THE INVENTION

Figure 9:
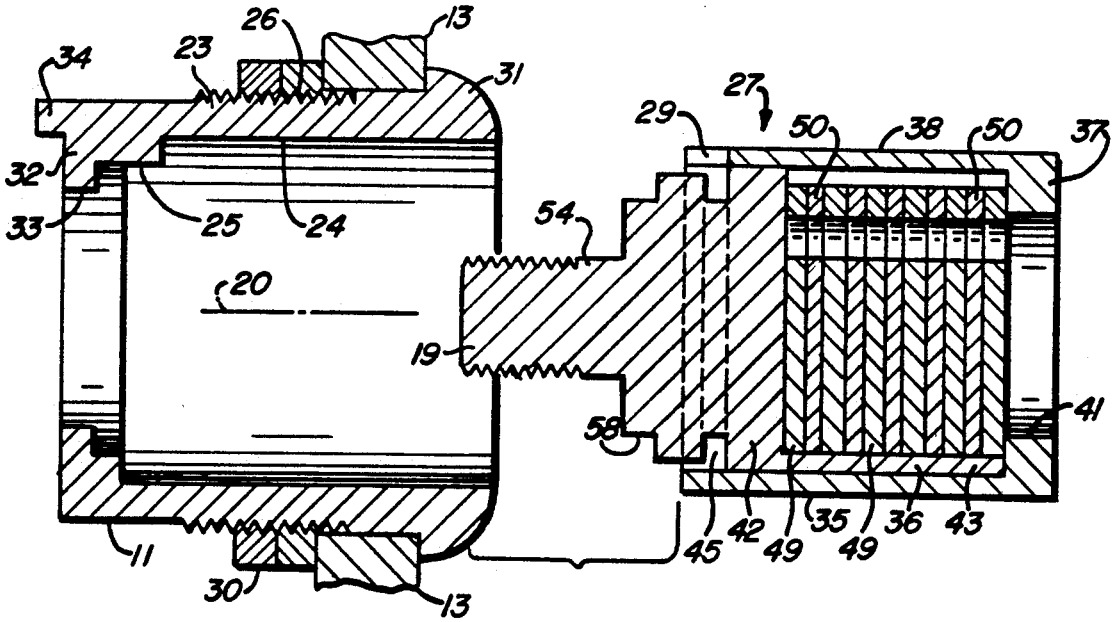
FIG. 9 is a view taken in the same direction as FIG. 1, but with certain lock components separated from one another.
Figure 10:
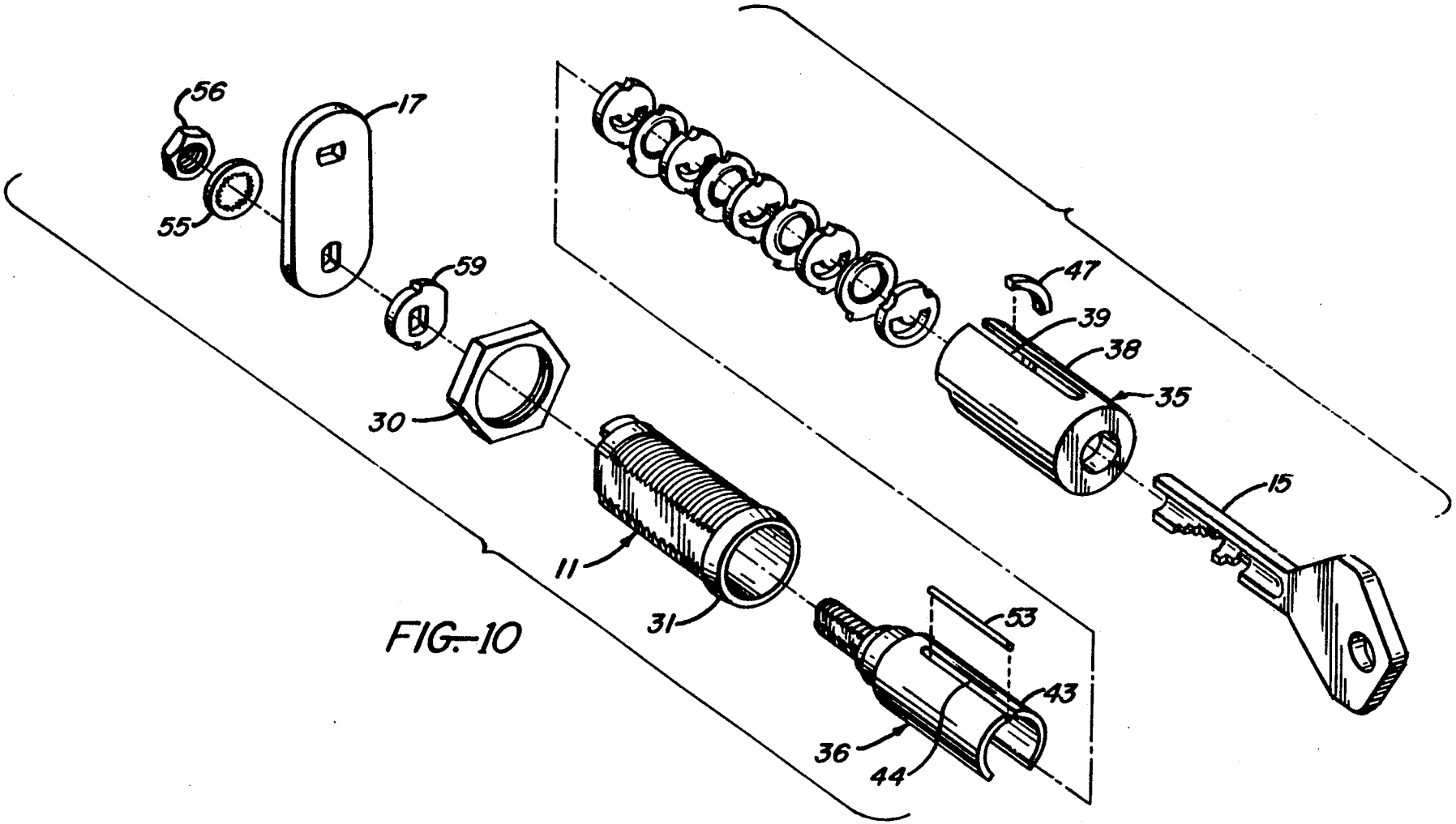
FIG. 10 is an exploded perspective view of a key-operated lock assembly according to the present invention.

FIGS. 1, 9 and 10 show a preferred embodiment of the invention as comprising a lock assembly including a shell 11 mounted on a hinged closure 13. The closure has an opening therethrough for acceptance of the shell. As viewed in FIGS. 1 and 9, the area left of closure 13 will usually be a space within a vending machine, laundry machine, or gambling machine, etc.; the area to the right of closure 13 is the room or zone wherein the machine is located. The function of the lock assembly is to prevent access to the machine interior space, except when a key 15 is inserted into the lock mechanism and turned to operate the locking element 17 (FIG. 1).

Figure 7:
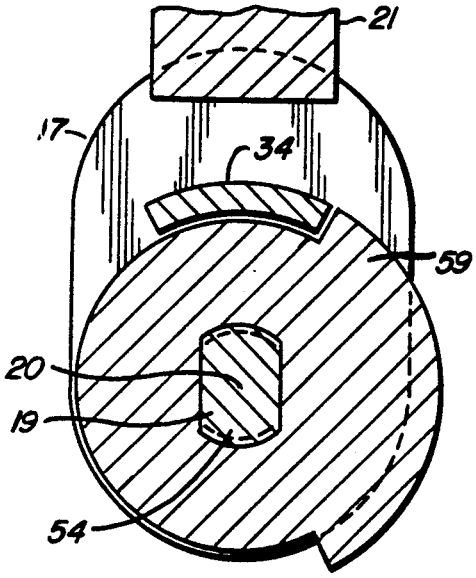
FIG. 7 is a view taken on line 7—7 in FIG. 1.

Locking element 17 is shown as a flat plate mounted on a shaft 19 extending rearwardly through the rear wall of shell 11. Manual manipulation of key 15 rotates shaft 19 about central axis 20, thus to enable locking plate 17 to swing into or out of registry with a fixed keeper plate 21 (FIGS. 1 and 7). FIG. 7 shows the position of locking plate 17 in its locked position extending behind plate 21; the locking element is moved to its unlocked position by swinging it clockwise about axis 20 so as to be out of registration with keeper plate 21. When the locking element 17 is in the unlocked position, closure 13 may be swung open to gain access to the machine interior space.

FIG. 9 illustrates the configuration of shell 11. The shell includes an annular side wall 23 having a generally smooth cylindrical inner surface 24 and a threaded outer surface 26. A segmental flat 25 is suitably formed on the interior surface area of the shell side wall to form a linear key means for accurately locating a lock-actuator cartridge 27 in the shell. FIG. 4 shows the flat 25 in profile. The cartridge includes a housing 35 that is movable axially into the shell so that a key slot 29 in the end of the cartridge housing wall 38 telescopes onto the shell wall area that forms flat 25, whereby the shell correctly orients the cartridge in the circumferential direction. In the installed position cartridge housing 35 is immovable relative to shell 11.

Shell 11 may be mounted in closure 13 by means of one or more nuts 30. The shell extends through the closure with its open front end facing the room and its closed rear end disposed within the machine. An annular flange 31 at the front end of the shell prevents the shell from being displaced in a front-to-rear direction.

The rear end of shell 11 is closed by a thickened rear wall 32 which extends generally transverse to the aforementioned rotational axis 20. A circular opening 33 in wall 32 accommodates the shaft 19. A lug 34 may be provided on wall 32 to limit the swinging movement of locking element 17 (as depicted generally in FIG. 7). Shell 11 is preferably of one-piece steel construction resistant to deformation or breakage. Shell rear wall 32 is thickened to prevent breakage or penetration by any forcible hammering action on the front face of cartridge 27.

Cartridge 27 comprises a hollow annular housing 35 and a tumbler carrier 36. In the position of FIGS. 1 and 9, the tumbler carrier is telescoped into housing 35. FIG. 10 shows the carrier 36 separated from housing 35. A stack of tumbler disks and spacer disks is supported in the carrier 36. When the carrier is separated from housing 35, as in FIG. 10, the various disks may be removed from the carrier and replaced with a different stack of disks (having a different orientation of gate notches).

Cartridge housing 35 comprises a thickened front wall 37 and a tubular side wall 38. The outer side surface of side wall 38 fits within and against shell inner surface 27, whereby the cartridge housing is immovable relative to the shell. An axial slot 39 extends along housing wall 38 from the rear face of wall 37 to the rear end of the housing. A segmental arcuate slot 40 is formed in housing wall 38, as best seen in FIG. 4. The rear end of housing 35 is open to enable the tumbler carrier 36 to be telescoped into and out of the housing. Front wall 37 of housing 35 has a circular opening 41 therethrough centered on central axis 20, which opening has a radius slightly larger than the radius of each keyhole slot 61 in each tumbler disk. A key 15 can be inserted through opening 41 into the keyhole.

Tumbler carrier 36 comprises a thickened rear wall 42 and a tubular side wall 43. An axial slot 44 is defined in side wall 43 to mate with slot 39 in the cartridge housing side wall 38. A circumferential groove 45 is formed in the peripheral edge of rear wall 42. When carrier 36 is telescoped into housing 35 (as in FIG. 9), groove 45 registers with the aforementioned arcuate slot 40. An arcuate segmental retainer 47 can then be inserted into slot 40 and groove 45 to prevent axial separation of tumbler carrier 36 from cartridge housing 35. FIG. 4 best shows the profile of arcuate retainer 47 and its relationship to groove 45. Since groove 45 is an endless circumferential groove, the arcuate retainer 47 does not prevent relative rotation between carrier 36 and housing 35. The carrier can rotate without transmitting rotational force to cartridge housing 35 or retainer 47.

As shown in FIG. 4, segmental retainer 47 has an extensive circumferential dimension 48, which dimension is preferably at least one hundred degrees measured from axis 20. A large circumferential retainer dimension is desirable in order to provide a relatively strong retainer structure capable of withstanding large axial loads that might be imposed by any attempt to axially separate housing 35 from tumbler carrier 36, e.g., by exerting a forward pulling force on housing front wall 37 with the cartridge in the FIG. 1 position.

As previously indicated, carrier 36 forms a support structure for a stack of tumbler disks and interspersed spacer disks. The tumbler disks are designated by numeral 49, whereas the spacer disks are designated by numeral 50. The spacer disks are keyed to carrier 36, thus to form fixed partitions isolating one tumbler disk from another tumbler disk. The tumbler disks can thus rotate independently without direct transmission of any rotational force from one tumbler disk to another.

Figure 8:
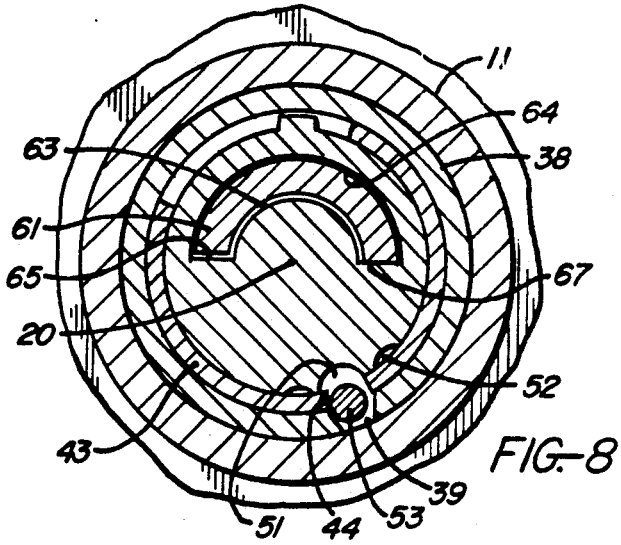
FIG. 8 is a view taken in the same direction as FIG. 3, showing a tumbler disk in a different position of rotation.

Each tumbler disk has one true gate (notch) 51 in its peripheral edge. Also, one or more shallower false gates (notches) 52 may be provided in each tumbler disk to provide false gate indications to a picking tool inserted into the tumbler interfaces. FIG. 3 shows a representative tumbler disk 49 in a position wherein its gate notch 51 is located to the right of slot 44 in the side wall of carrier 36. FIG. 8 shows the tumbler disk 49 rotated clockwise to a position wherein notch (gate) 51 is aligned with slot 44. FIG. 3 represents the lock mechanism in a locked condition, whereas FIG. 8 represents the lock mechanism in its unlocked condition.

The illustrated lock has six tumbler disks 49. Typically a lock may have about eleven tumbler disks. The gate 51 locations will (or can) be different in the different disks, whereby a peculiarly configured key 15 is required to rotate all of the tumbler disks to positions wherein all of the tumbler disk gates 51 are simultaneously aligned with carrier slot 44. When all of the six gates 51 are aligned with slot 44, an elongated cylindrical drive pin 53 is enabled to move out of housing slot 39 and into the gates 51, thereby locking carrier 36 to the various disks 49. Pin 53 transmits a drive force from disks 49 to carrier 36, whereby the carrier can operate the aforementioned locking element 17 to its unlatched position (rotated clockwise from the position shown in FIG. 7). When the lock is in its locking condition, as shown in FIG. 3, drive pin 53 is contained within slots 39 and 44. Carrier 36 is thus prevented from rotation.

The drive connection between carrier 36 and locking element 17 comprises the aforementioned shaft 19. Referring to FIGS. 1 and 7, shaft 19 has a circular section 58 within hole 33 in shell rear wall 32, and a non-circular section 54 extending through mating holes in locking element 17 and stop plate 59. FIG. 7 shows the cross sectional configuration of shaft section 54. The extreme rear end area of shaft section 54 is threaded to receive a lock washer 55 and a nut 56.

Locking element 17 is keyed to shaft 19, whereby rotary motion of carrier 36 causes element 17 to be moved into or out of locking engagement with keeper plate 21. Plate 59 may be contoured as shown in FIG. 7 to provide abutment surfaces engageable with the aforementioned lug 34 for limiting the swinging motion of the locking element.

FIGS. 1, 2, 6 and 10 illustrate the general features of a key 15 which can be used to rotate the tumbler disks 49 for opening or closing the lock. Each tumbler disk may have a semicircular keyhole 61 centered on rotational axis 20. Each keyhole has an arcuate inner edge 63, an arcuate outer edge 64, and two end edges 65 and 67. The mating key has a mating arcuate cross-section, except that edge areas of the key cross-section are cut away to provide the necessary lost motion connections between the key edges and the keyslot end edges. FIG. 3 shows a representative section cut from the key blank to provide a desired key profile. The key-keyhole relationship is similar to that disclosed in my issued U.S. Pat. No. 4,838,055. One advantage of the illustrated key construction is that it uses a relatively narrow edge of the key to drive the tumbler disks. The load acts circumferentially along the major dimension of the key cross-section. Also, the thin edge makes it difficult for a thief attempting to operate the tumblers with a picking tool. The narrow end edge of each keyhole slot does not provide a very large support base for the picking tool. The tool has to be a relatively thin fragile instrument, not well suited for rotating the tumblers.

In order to make it more difficult to defeat the lock with a picking tool, the end edges of the key slot and key may preferably be of stepped construction, as depicted in FIG. 5. As shown, end edge 65*a* of the keyhole has two steps, whereas end edge 67*a* of the keyhole has one step. The associated key will have similarly stepped end edges. The stepped end edges on the keyhole are advantageous in that they restrict the support action on any picking tool that might be inserted through the keyhole. The stepped key edge configuration is advantageous in that it is a special structure difficult to duplicate, except through the use of special tooling or equipment.

FIGS. 1, 4 and 9 illustrate a principal feature of the invention. As shown in FIG. 9, the lock-actuator cartridge may be removed as an entity from shell 11, i.e., by first unscrewing nut 56, and then removing elements 17 and 59 from actuator shaft 19. With the cartridge removed from shell 11 (as shown in FIG. 9), segmental retainer 47 (FIG. 4) can be lifted out of arcuate slot 40 to permit carrier 36 to be axially separated from cartridge housing 35. The disks 49 and 50 may then be removed from the carrier and replaced with a different stack of disks (having a different gate 51 pattern).

The cartridge housing 35 can be reinstalled on the loaded carrier 36, and the segmental retainer 47 reinserted into slot 40 and groove 45. Drive pin 53 will be reinstalled into slots 39 and 44 prior to the cartridge being reinserted into shell 11. It will be noted that shell 11 remains attached to closure 13 during the rekeying operation. Preferably, the sub-steps of removing and installing the disks 49 and 50 in the cartridge are performed in a locksmith facility or shop. The only operations performed at the job site are removing and reinstalling nut 56, and removing and inserting the loaded cartridge. The job site operations can be performed quickly, and with minimum chance of error in mating the lock to the appropriate key. The job of matching a loaded cartridge to a particular key may be performed at the locksmith facility.

The key-operated lock can be formed of any desired size. However, the lock construction is adapted for manufacture in relatively small sizes. Typically shell 11 may have a diameter of about three quarters of one inch.

Thus there has been shown and described a novel lock having removable lock-actuator cartridge which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A key-operated lock comprising:

an annular shell having an outer side surface and an inner side surface, means for mounting said shell to extend through a closure, said shell having a central axis normal to the closure, an open front end, and a closed rear end, said shell open front end comprising an annular flange engageable with one face of the closure to prevent displacement of the shell in a front-to-rear direction, said shell rear end comprising a thickened rear wall having an axial opening therethrough on the shell central axis, retainer means threadable on the outer side surface of said shell for securing the shell to a closure, said retainer means being accessible only when the closure is in an opened condition, a lock-actuator cartridge removably mounted within said shell, said cartridge comprising a hollow housing having an outer side surface slidably supported on the shell inner side surface and an annular front wall extending radially inwardly of the housing side surface, a tumbler carrier telescoped within said housing, and a series of removable tumblers contained within said carrier, said carrier having a solid rear end surface engaging the shell rear wall to prevent rearward movement of the cartridge, and a shaft extending axially from said rear end surface through said axial opening, and a locking element removably attached to said shaft in the space behind the shell, said tumblers being key-operated, whereby the carrier and tumblers can be rotated as a unit to operate the locking element, said lock-actuator cartridge being a self-contained assembly movable as a unit through the front end of the shell only upon removal of the locking element from the shaft, said carrier being separable from said housing by axial movement of the carrier away from the housing front wall only after the cartridge has been removed from the shell, whereby the tumbler replacement process is accomplished without disturbing the position of the shell in the closure.

2. A key-operated lock according to claim 1, wherein:

said cartridge housing has a thickened front wall (37) and a tubular side wall (35), said carrier has a thickened rear wall (42) and a tubular side wall (43) telescopically nested within the housing side wall, said housing side wall and carrier side wall have mating axial slots (39 and 44) therethrough, said tumblers comprising tumbler disks have gate notches therein registrable with the axial slot in the carrier side wall, and a lock control drive pin is movable between a first position spanning the axial slots and a second position spanning the carrier slot and gate notches.

3. A key-operated lock according to claim 2, and further comprising:

means for preventing axial separation of said carrier and said housing, said separation prevention means being so engaged with the carrier that the carrier can rotate within the housing without interfering with the action of the separation prevention means.

4. A key-operated lock according to claim 3, wherein said axial separation prevention means comprises a peripheral circumferential groove in the carrier rear wall, a segmental arcuate slot in the housing side wall, and an arcuate segmental retainer extending within said arcuate slot into said groove.

5. A key-operated lock according to claim 4, wherein said segmental retainer has a circumferential dimension of at least one hundred degrees.

6. A key-operated lock of claim 2, wherein:

said cartridge housing front wall has a circular opening therethrough centered on the shell central axis, each tumbler disk has a semi-circular key slot centered on the shell central axis, and the key slot radius is slightly smaller than the radius of the circular opening in the cartridge housing front wall.

7. A key-operated lock according to claim 6, wherein:

each semi-circular key slot has an arcuate inner edge, arcuate outer edge, and two end edges, and at least one of said end edges has a stepped configuration to minimize the potential support surface available for a lock picking tool inserted into the key slots.

8. A key-operated lock according to claim 1, and further comprising:

an annular stop plate carried on said shaft between said locking element and the closed rear end of said shell, whereby said cartridge is retained within the shell when the locking element is attached to the shaft.

* * * * *